US007617680B1

(12) United States Patent
Weaver et al.

(10) Patent No.: US 7,617,680 B1
(45) Date of Patent: Nov. 17, 2009

(54) POWER GENERATION USING LOW-TEMPERATURE LIQUIDS

(75) Inventors: Samuel C. Weaver, Knoxville, TN (US); Daniel Weaver, Boulder, CO (US); Samuel P. Weaver, Boulder, CO (US)

(73) Assignee: Cool Energy, Inc., Knoxville, TN (US)

( * ) Notice: Subject to any disclaimer, the term of this patent is extended or adjusted under 35 U.S.C. 154(b) by 399 days.

(21) Appl. No.: 11/467,854

(22) Filed: Aug. 28, 2006

(51) Int. Cl.
*G21D 5/00* (2006.01)

(52) U.S. Cl. ..... 60/644.1; 60/641.8; 60/517

(58) Field of Classification Search ..... 60/644.1, 60/641.8, 517
See application file for complete search history.

(56) References Cited

U.S. PATENT DOCUMENTS

| | | | | |
|---|---|---|---|---|
| 3,006,146 | A | | 10/1961 | Jackson |
| 3,533,232 | A | * | 10/1970 | Hodgson ..... 60/39.47 |
| 3,638,420 | A | | 2/1972 | Kelly et al. |
| 3,772,883 | A | | 11/1973 | Davoud et al. |
| 3,996,745 | A | | 12/1976 | Davoud et al. |
| 4,055,962 | A | | 11/1977 | Terry |
| 4,148,195 | A | | 4/1979 | Gerstmann et al. |
| 4,149,389 | A | | 4/1979 | Hayes et al. |
| 4,313,304 | A | | 2/1982 | Hunt |
| 4,532,778 | A | | 8/1985 | Clark et al. |
| 4,586,334 | A | | 5/1986 | Nilsson, Sr. et al. |
| 4,753,072 | A | | 6/1988 | Johansson et al. |
| 4,894,989 | A | | 1/1990 | Mizuno et al. |
| 4,897,997 | A | | 2/1990 | Meijer et al. |
| 5,010,734 | A | | 4/1991 | Ho |
| 5,115,157 | A | | 5/1992 | Blumenau |
| 5,195,321 | A | | 3/1993 | Howard |
| 5,228,293 | A | | 7/1993 | Vitale |
| 5,428,653 | A | * | 6/1995 | El-Genk ..... 376/318 |
| 5,638,684 | A | | 6/1997 | Siegel et al. |
| 5,706,659 | A | | 1/1998 | Houtman |
| 5,899,071 | A | | 5/1999 | Stone et al. |
| 5,916,140 | A | | 6/1999 | Hageman |
| 5,918,463 | A | | 7/1999 | Penswick et al. |

(Continued)

FOREIGN PATENT DOCUMENTS

| | | | |
|---|---|---|---|
| DE | 19843600 | A1 | 3/1999 |
| JP | 4093559 | A | 3/1992 |

OTHER PUBLICATIONS

"Low-Cost Solar-Thermal-Electric Power Generation," author unknown, found online on Jul. 18, 2008 at http://www.cs.berkeley.edu/~artin/Research/research.html, 6 pages.

(Continued)

*Primary Examiner*—Hoang M Nguyen
(74) *Attorney, Agent, or Firm*—Townsend and Townsend and Crew LLP

(57) ABSTRACT

Methods and systems are disclosed for generating power though the use of thermodynamic engines and low-temperature liquids. A liquid cryogen maintains a temperature differential with a heat source across a thermodynamic engine. The thermodynamic engine is run to convert heat provided in the form of the temperature differential to a nonheat form of energy. Cryogen vapor produced by vaporization of the liquid cryogen is collected and combusted to generate additional energy.

24 Claims, 4 Drawing Sheets

U.S. PATENT DOCUMENTS

| | | | | |
|---|---|---|---|---|
| 5,934,076 | A | 8/1999 | Coney | |
| 6,305,442 | B1 * | 10/2001 | Ovshinsky et al. | 141/231 |
| 6,330,800 | B1 | 12/2001 | Price et al. | |
| 6,470,679 | B1 | 10/2002 | Ertle | |
| 6,536,207 | B1 | 3/2003 | Kamen et al. | |
| 6,606,860 | B2 * | 8/2003 | McFarland | 60/648 |
| 6,625,992 | B2 | 9/2003 | Maguire et al. | |
| 6,701,721 | B1 | 3/2004 | Berchowitz | |
| 6,948,315 | B2 | 9/2005 | Kirby et al. | |
| 2005/0172623 | A1 | 8/2005 | Hurt | |
| 2005/0279094 | A1 * | 12/2005 | Yoshino | 60/641.8 |

OTHER PUBLICATIONS

Der Menassians, Artur, "Stirling Engines for Low-Temperature Solar-Thermal-Electric Power Generation," Written Dissertation from the University of CA Berkeley, 2007, 205 pages.

Der Menassians, Artur, "Stirling Engines for Low-Temperature Solar-Thermal-Electric Power Generation," Dissertation Talk, Nov. 19, 2007, 34 pages.

Senft, James R, "An Introduction to Stirling Engines", Moriya Press, 1993, pp. 40-43.

* cited by examiner

POWER GENERATION USING LOW-TEMPERATURE LIQUIDS

CROSS-REFERENCES TO RELATED APPLICATION

This application is related to concurrently filed, commonly assigned U.S. patent application Ser. No. 11/467,819, entitled "POWER GENERATION USING THERMAL GRADIENTS MAINTAINED BY PHASE TRANSITIONS," filed by Samuel C. Weaver et al., the entire disclosure of which is incorporated herein by reference for all purposes.

BACKGROUND OF THE INVENTION

This application relates generally to power generation. More specifically, this application relates to the use of phase transitions to maintain thermal gradients in power generation.

The use of thermodynamic techniques for converting heat energy into mechanical, electrical, or some other type of energy has a long history. The basic principle by which such techniques function is to provide a large temperature differential across a thermodynamic engine and to convert the heat represented by that temperature differential into a different form of energy. Typically, the heat differential is provided by hydrocarbon combustion, although the use of other techniques is known. Using such systems, power is typically generated with an efficiency of about 30%, although some internal-combustion engines have efficiencies as high as 50% by running at very high temperatures.

Conversion of heat into mechanical energy is typically achieved using an engine like a Stirling engine, which implements a Carnot cycle to convert the thermal energy. The mechanical energy may subsequently be converted to electrical energy using any of a variety of known electromechanical systems. Thermoelectric systems may be used to convert heat into electrical energy directly, although thermoelectric systems are more commonly operated in the opposite direction by using electrical energy to generate a temperature differential in heating or cooling applications.

While various power-generation techniques thus exist in the art, there is still a general need for the development of alternative techniques for generating power. This need is driven at least in part by the wide variety of applications that make use of power generation, some of which have significantly different operational considerations than others.

BRIEF SUMMARY OF THE INVENTION

Embodiments of the invention provide methods and systems for generating power though the use of thermodynamic engines and low-temperature liquids. A liquid cryogen is provided in thermal communication with a thermodynamic engine to maintain a temperature differential across the thermodynamic engine with a heat source. The thermodynamic engine is run to convert heat provided in the form of the temperature differential to a nonheat form of energy. Cryogen vapor produced by vaporization of the liquid cryogen is collected and combusted to generate additional energy.

There are a number of different ways that the heat source may be provided in different embodiments. For example, in one embodiment the heat source comprises an ambient environment within which the thermodynamic engine is disposed. Combustion of the cryogen vapor may produce heat in thermal communication with the heat source to enhance the temperature differential across the heat engine. The heat source may also sometimes comprise waste heat produced by a second power-generation method.

A variety of different liquid cryogens may also be used in different embodiments. In one embodiment, the liquid cryogen has a boiling point less than −150° C. Examples of suitable liquid cryogens include liquid nitrogen, liquid neon, liquid helium, liquid hydrogen, liquid carbon monoxide, liquid argon, and liquid krypton.

Embodiments of the invention may also make use of different thermodynamic engines. For instance, in one embodiment, the thermodynamic engine comprises a Stirling engine and the nonheat form of energy comprises mechanical energy. In another embodiment, the thermodynamic engine comprises a thermoelectric engine and the nonheat form of energy comprises electrical energy. In some instances, running the thermodynamic engine comprises operating a Rankine engine by generating vapor from a liquid with the heat source and condensing the vapor with the liquid cryogen.

In certain embodiments, a mechanism is provided for replenishment of the cryogen source. For instance, in one embodiment, combustion of the cryogen vapor comprises oxidation of the cryogen vapor to produce a cryogen oxide, which may subsequently by electrolyzed.

In one specific embodiment, a method for generating power provides a Stirling engine in an ambient environment. Liquid hydrogen is provided in thermal communication with the Stirling engine to maintain a temperature differential across the Stirling engine with the ambient environment. The Stirling engine is run to convert heat represented by the temperature differential into mechanical energy. Hydrogen vapor produced by vaporization of the liquid hydrogen is collected. The hydrogen vapor is oxidized to generate additional energy. A portion of the ambient environment is heated locally proximate the Stirling engine with heat generated by oxidizing the hydrogen vapor to enhance the temperature differential across the Stirling engine.

BRIEF DESCRIPTION OF THE DRAWINGS

A further understanding of the nature and advantages of the present invention may be realized by reference to the remaining portions of the specification and the drawings wherein like reference numerals are used throughout the several drawings to refer to similar components. In some instances, a sublabel is associated with a reference numeral and follows a hyphen to denote one of multiple similar components. When reference is made to a reference numeral without specification to an existing sublabel, it is intended to refer to all such multiple similar components.

DETAILED DESCRIPTION OF THE INVENTION

Figures 1A, 1B, 1C, 1D:
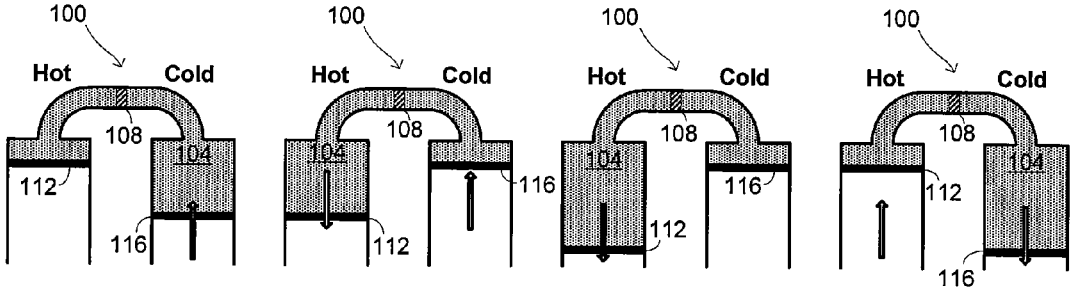
FIGS. 1A-1D show different stages in the operation of a two-piston Stirling engine.

Embodiments of the invention make use of cryogens to maintain a thermal gradient to drive a thermodynamic engine. As used herein, a "thermodynamic engine" refers to any device or system capable of converting thermal energy to a different form of energy. Examples of thermodynamic engines include engines like external and internal combustion engines that effect an energy conversion between mechanical energy and heat energy from a temperature differential; and engines like thermoelectric, pyroelectric, and thermophotovoltaic engines that effect a conversion between electrical energy and heat energy from a temperature differential.

A Stirling engine is sometimes referred to in the art as an "external combustion engine" and typically operates by burning a fuel source to generate heat that increases the temperature of a working fluid, which in turn performs work. The operation of one type of conventional Stirling engine is illustrated in FIGS. 1A-1E. Each of FIGS. 1A-1D shows the configuration of the Stirling engine 100 at a different position during a single cycle, with the engine 100 operating by changing positions sequentially from FIG. 1A to FIG. 1D and then returning to the configuration shown in FIG. 1A. The phase diagram shown in FIG. 1E also shows this cycle, but from the perspective of relevant thermodynamic variables. The phase diagram is a pressure-volume diagram, with pressure being plotted on the ordinate and volume being plotted on the abscissa. Relevant isotherms 124 and 128 are shown with dotted lines.

The mechanical energy produced by the Stirling engine 100 is indicated by positions of pistons 112 and 116. To use or retain the energy, the pistons 112 and 116 may be connected to a common shaft that rotates or otherwise moves in accordance with the changes in piston positions that result from operation of the engine 100. A confined space between the two pistons 112 and 116 is filled with a compressible fluid 104, usually a compressible gas. The temperature difference is effected by keeping one portion of the fluid 104, in this instance the portion on the left, in thermal contact with a heat source and by keeping the other portion, in this instance the portion on the right, in thermal contact with a heat sink. With such a configuration, piston 112 is sometimes referred to in the art as an "expansion piston" and piston 116 is sometimes referred to as a "compression piston." The portions of the fluid are separated by a regenerator 108, which permits appreciable heat transfer to take place to and from the fluid 104 during different portions of the cycle describe below. This heat transfer either preheats or precools the fluid 104 as it transitions from one chamber to the other.

Figure 1E:
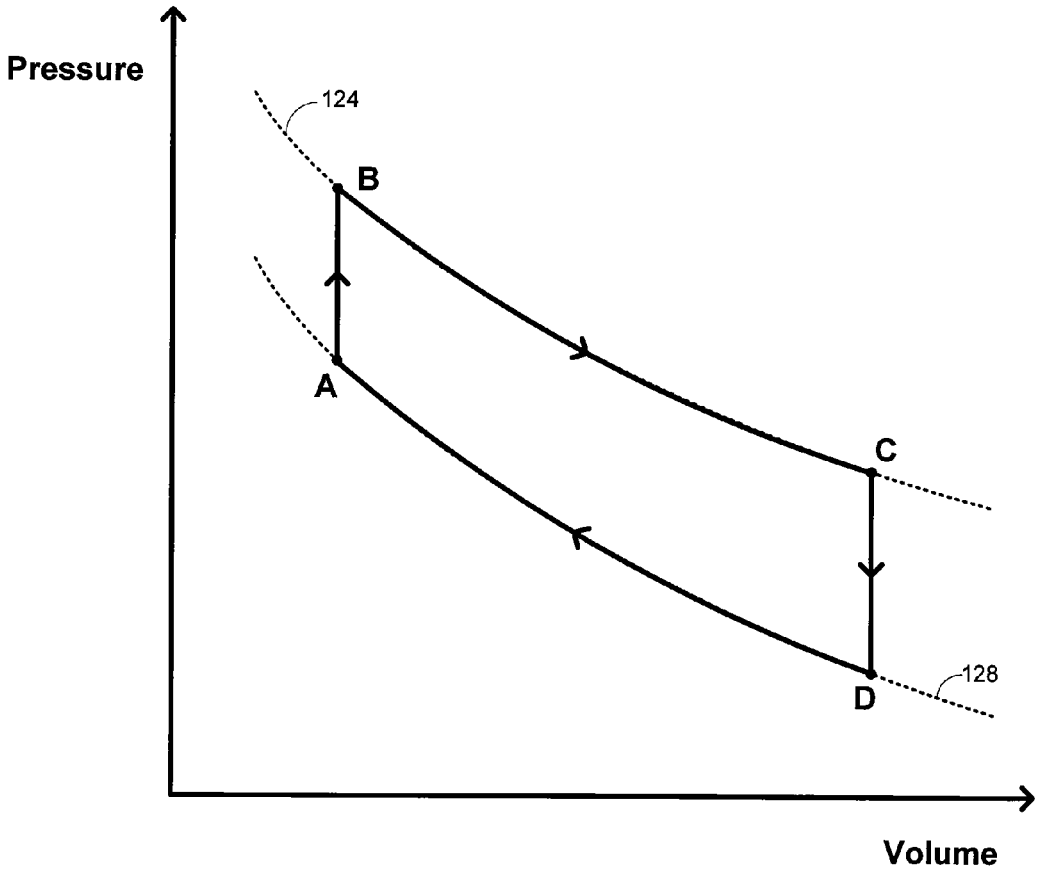
FIG. 1E is a phase diagram showing the thermodynamic operation of the Stirling engine.

When the engine is in the position shown in FIG. 1A, the fluid 104 has a pressure and volume that correspond to point "A" in FIG. 1E. In this phase diagram, isotherm 128 corresponds to a temperature $T_c$ of the cold side and isotherm 124 corresponds to a temperature $T_h$ of the hot side. During the portion of the cycle from FIG. 1A to FIG. 1B, the expansion piston 112 moves down at the same time that the compression piston 116 moves up, maintaining a constant volume for the fluid 104. During such a change, fluid 104 passes through the regenerator 108 from the cold side to the hot side. Heat $Q_R$ supplied by the regenerator 108 causes the fluid to enter the hot side at temperature $T_h$. The constant volume of this part of the cycle is represented by a vertical line in FIG. 1E to point "B."

The transition to the configuration shown in FIG. 1C is achieved by maintaining the compression piston 116 in a substantially fixed position while moving the expansion piston 112 downwards to increase the volume containing the fluid 104. This causes the fluid to undergo a substantially isothermal expansion, as represented in the phase diagram by a traversal along isotherm 124 to point "C." During this expansion, heat $Q_h$ is absorbed into the working fluid at temperature $T_h$ from the thermal contact of the fluid 104 with the heat source. The heat is turned into mechanical work W during this expansion.

The portion of the cycle to FIG. 1D is a counterpart to the portion of the cycle between the configurations of FIGS. 1A and 1B, with both pistons 112 and 116 moving in concert to maintain a substantially constant volume. In this instance, however, fluid is forced in the other direction through the regenerator 108, causing a decrease in temperature to $T_c$ represented by the vertical line in FIG. 1E to point "D." During this part of the cycle, substantially the same amount of heat $Q_R$ absorbed during the transition between FIGS. 1A and 1B is given up to the regenerator 108. The two constant-volume transitions in the cycle accordingly have substantially no net effect on the heat-transfer characteristics of the process.

Finally, a return is made to the configuration of FIG. 1A by moving the compression piston 116 upwards while maintaining the expansion piston 112 in a substantially fixed position. The resulting compression of the fluid 104 is again substantially isothermic, as represented by the traversal along isotherm 128 at temperature $T_c$ in FIG. 1E back to point "A." During this compression, heat $Q_c$ is removed from the working fluid as a result of contact of the fluid 104 with the heat sink.

The net result of the cycle is a correspondence between (1) the mechanical movement of the pistons 112 and 116 and (2) the absorption of heat $Q_h$ at temperature $T_h$ and the rejection of heat $Q_c$ at temperature $T_c$. The work performed by the pistons 112 and 116 is accordingly $W=|Q_h-Q_c|$.

The type of Stirling engine illustrated in FIGS. 1A-1D is a two-piston type of Stirling engine. This type of configuration is sometimes referred to in the art as having an "alpha" configuration. Other configurations for Stirling engines may be implemented that traverse a similar thermodynamic path through the pressure-volume phase diagram of FIG. 1E. One alternative configuration for a Stirling engine uses a displacer-type of engine, an example of which is illustrated schematically in FIGS. 2A-2D. This type of configuration is sometimes referred to in the art as having a "gamma" configuration. The fundamental principle of operation of the displacer type of Stirling engine is the same as for the two-piston type of Stirling engine in that thermal energy represented by a temperature differential is converted to mechanical energy. Still other types of configurations may be used in implementing a Stirling engine, including arrangements that are sometimes referred to in the art as having a "beta" configuration.

With the displacer-type of Stirling engine 200, fluid 224 that expands with a heat-energy increase is held within an enclosure that also includes a displacer 228. The fluid 224 is typically a gas. One or both sides of the engine 200 are maintained in thermal contact with respective thermal reservoirs to maintain the temperature differential across the engine. In the illustration, the top of the engine 200 corresponds to the cold side and the bottom of the engine 200 corresponds to the hot side. A displacer piston 204 is provided in mechanical communication with the displacer 228 and a power piston 208 is provided in mechanical communication with the fluid 224. Mechanical energy represented by the motion of the power piston 208 may be extracted with any of a variety of mechanical arrangements, with the drawing explicitly showing a crankshaft 216 in mechanical communication with both the displacer and power pistons 204 and 208. The crankshaft is illustrated as mechanically coupled with a flywheel 220, a common configuration. This particular mechanical configuration is indicated merely for illustrative purposes since numerous other mechanical arrangements will be evident to those of skill in the art that may be coupled with the power piston 208 in extracting mechanical energy. In these types of embodiments, the displacer 228 may also have a regenerator function to permit heat transfer to take place to and from the fluid 224 during different portions of the cycle.

It is noted that in the illustrated embodiment, the direct crankshaft provides a displacer motion that is substantially sinusoidal. More generally, a variety of alternative techniques may be used to couple or decouple the motion of the displacer. For instance, alternative displacer motions may be provided through the use of Ringbom-type engines and free piston designs, among others.

Figure 2A:
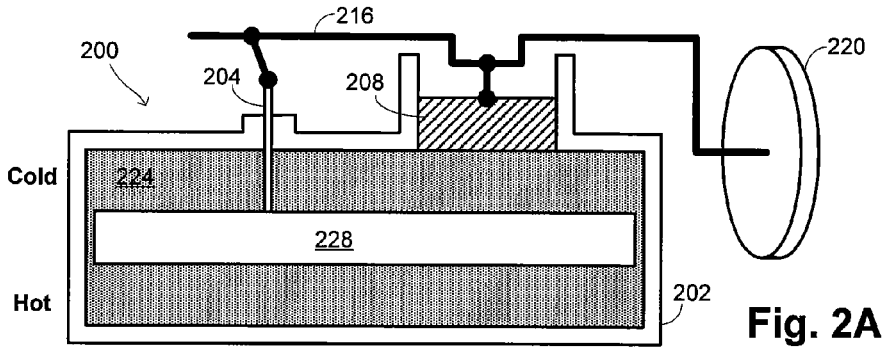
FIGS. 2A-2D show different stages in the operation of a displacer-type Stirling engine.
Figure 2B:
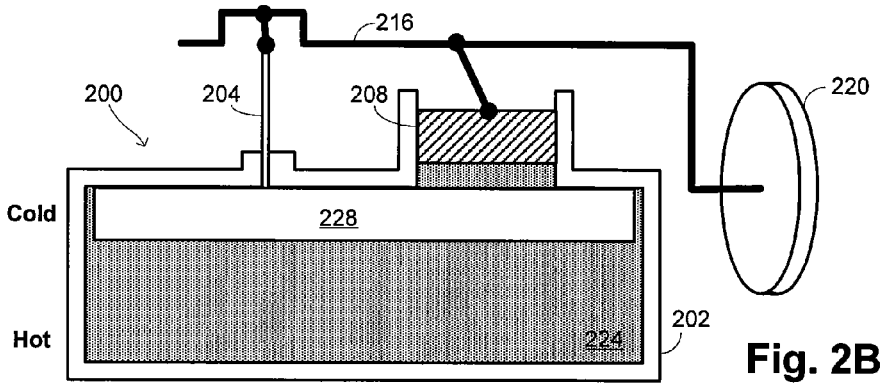

When the displacer Stirling engine 200 is in the configuration shown in FIG. 2A, it has a thermodynamic state corresponding to point "A" in FIG. 1E. Heating of the fluid 224 on the lower side of the engine 200 causes the pressure to increase, resulting in movement of the power piston 208 upwards as illustrated in FIG. 2B. This transition is represented thermodynamically in FIG. 1E with a transition to point "B." With the fluid 224 primarily in contact with the hot side of the engine, expansion of the fluid 224 takes place to drive the power piston 208 further upwards. This transition is substantially isothermic and is illustrated in FIG. 1E with a transition to point "C," corresponding to the arrangement shown in FIG. 2C.

Figure 2C:
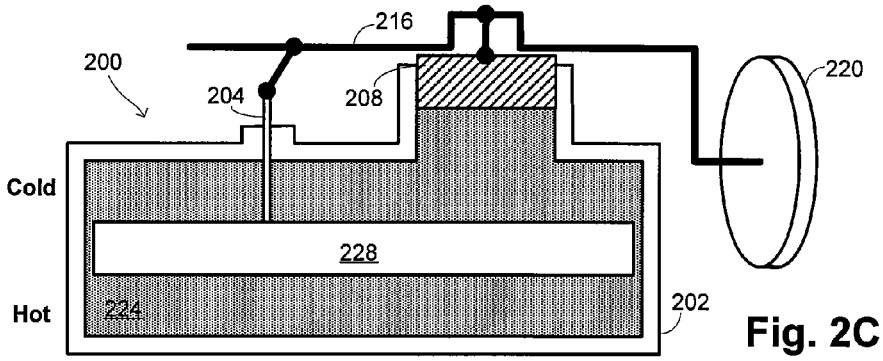
Figure 2D:
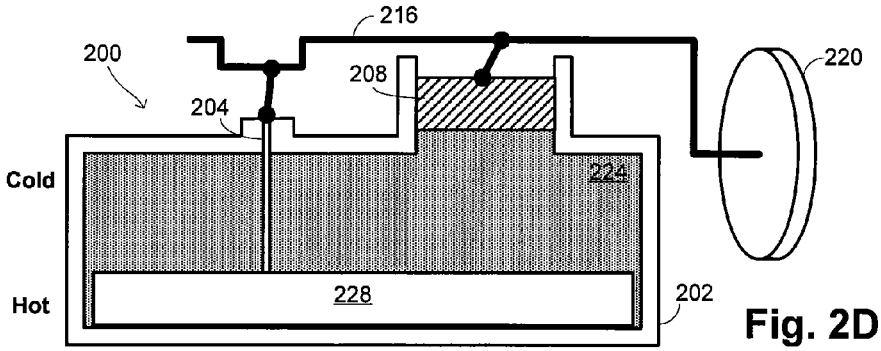

In FIG. 2C, expansion of the fluid 224 has been accompanied by reverse motion of the displacer 228, causes more of the fluid 224 to come in contact with the cold side of the engine 200 and thereby reduce the pressure. This is illustrated in FIG. 1E with the transition to point "D," corresponding to the arrangement shown in FIG. 2D. Cooling of the fluid 224 induces a substantially isothermic contraction illustrated in FIG. 1E with a return to point "A" and with the engine returning to the physical configuration shown in FIG. 2A.

This basic cycle is repeated in converting thermal energy to mechanical energy. In each cycle, the pressure increases when the displacer 228 is in the top portion of the enclosure 202 and decreases when the displacer 228 is in the bottom portion of the enclosure 202. Mechanical energy is extracted from the motion of the power piston 208, which is preferably 90° out of phase with the displacer piston 204, although this is not a strict requirement for operation of the engine.

Other types of thermodynamic engines make use of similar types of cycles, although they might not involve mechanical work. For instance, thermoelectric engines typically exploit the Peltier-Seebeck effect, which relates temperature differentials to voltage changes. Other physical effects that may be used in converting temperature differentials directly to electrical energy include thermionic emission, pyroelectricity, and thermophotovoltaism. Indirect conversion may sometimes be achieved with the use of magnetohydrodynamic effects.

Figure 3:
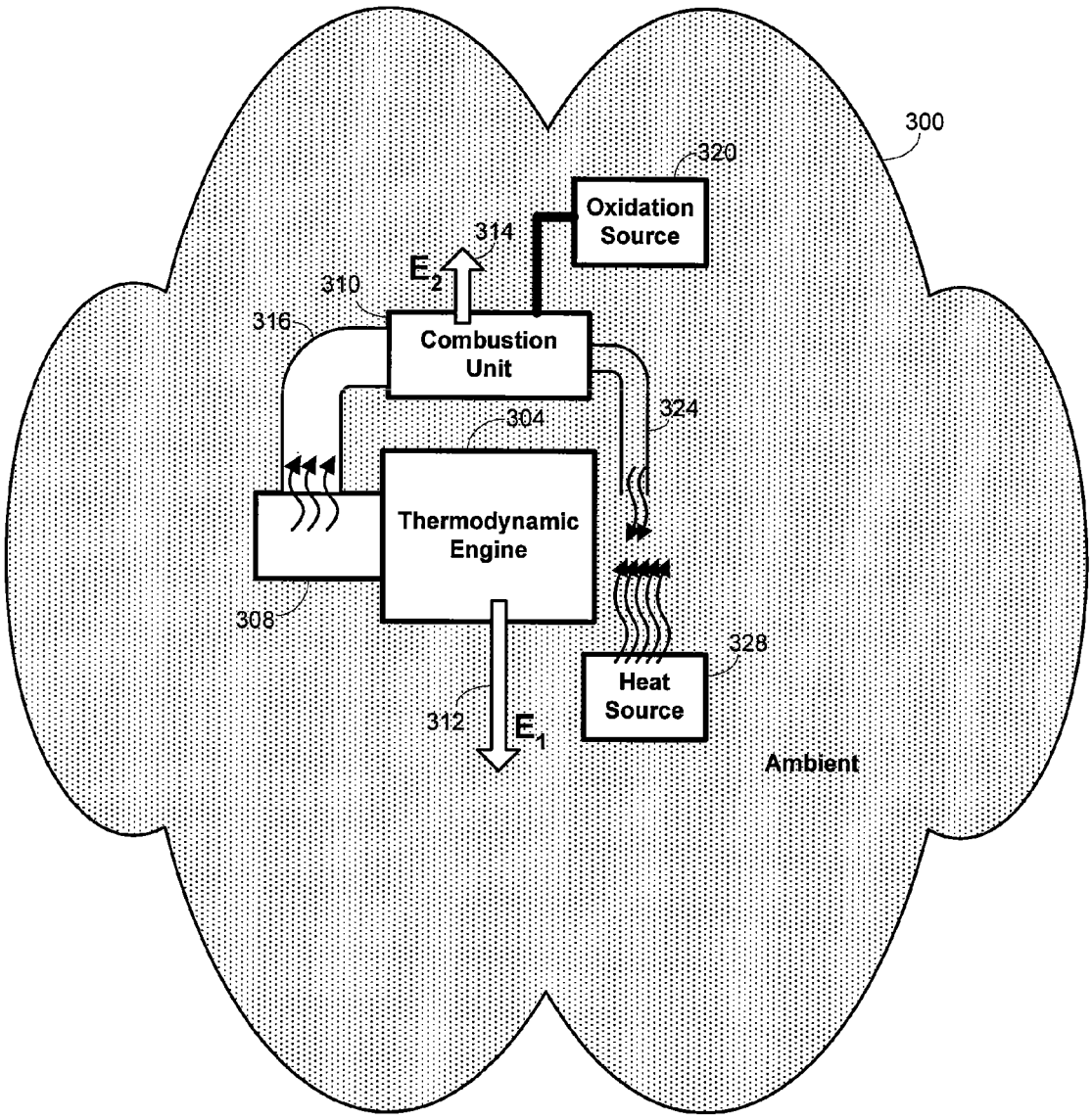
FIG. 3 is a schematic illustrating embodiments of the invention for using cryogens in power generation.

Embodiments of the invention make use of a thermodynamic engine in generating power, with the thermodynamic engine sometimes being disposed in an ambient environment as illustrated schematically in FIG. 3. In other embodiments, the engine may be disposed in another type of environment, particularly an environment that is controlled to produce desired thermal characteristics. Irrespective of whether the environment that contains the thermodynamic engine 304 is an ambient 300 or other environment, operation of the thermodynamic engine 304 is achieved by establishing a temperature differential across the engine 304.

In embodiments of the invention, this temperature differential is established by providing a cryogen 308 on one side of the engine 304. As used herein, a "cryogen" refers to any material that has a low-temperature boiling point. In specific embodiments, the cryogen 308 has a boiling point less than −150° C. Examples of cryogens that may be used in certain embodiments are provided in Table I, which also lists some relevant physical properties of such cryogens.

TABLE I

Exemplary Cryogens

| Cryogen | Boiling Point (° C.) | Latent Heat of Evaporation at Boiling Point (kJ/kg) | Specific Heat Capacity of Liquid at Boiling Point (kJ/kg K) | Thermal Conductivity of Liquid at Boiling Point (W/mK) |
|---|---|---|---|---|
| $N_2$ | −195.8 | 199.1 | 2.03 | 0.14 |
| Ne | −246.1 | 87.2 | 1.84 | 0.11 |
| $^3He$ | −270.0 | 15.9 | | 0.017 |
| $^4He$ | −269.0 | 20.9 | 4.41 | 0.027 |
| $H_2$ | −252.8 | 448.3 | 9.28 | 0.12 |
| CO | −191.5 | 215.9 | 2.21 | 0.14 |
| Ar | −185.9 | 163.2 | 1.05 | 0.13 |
| Kr | −153.4 | 107.7 | 0.54 | |

The invention is not intended to be limited by the particular type of thermodynamic engine 304 that is used. While some of the discussion that follows explains operation in the context of a Stirling engine like that described above, this is done merely for illustrative purposes; other types of thermodynamic engines, particularly including thermoelectric, pyroelectric, and thermophotovoltaic engines may be used in alternative embodiments.

The wavy arrows emanating from the cryogen source 308 indicate vaporization of the liquid cryogen. This is a particular form of phase transition that may be induced in substances disposed in an arrangement like that illustrated in FIG. 3 by conditions in the surrounding environment 300. The presence of the cryogen source 308 establishes a temperature difference across the thermodynamic engine that may be used to extract energy $E_1$ 312. The efficiency of energy extraction in this way by operation of the thermodynamic engine alone depends on the size of the temperature difference. For example, in cases where the surrounding environment is an ambient environment having a temperature of 300 K and the cryogen source comprises liquid $N_2$, the Carnot-cycle efficiency is $$\varepsilon_{N_2} = \frac{T_{ambient} - T_{cryogen}}{T_{ambient}} = \frac{300K - 77.3K}{300K} = 74\%.$$

To produce 1 kW of power with this efficiency, 1.35 kW of ambient heat may be extracted with 0.35 kW of ambient heat being rejected. This efficiency may be compared with the efficiency of a typical coal-fired power plant, which typically operate with about a 30% efficiency, generating about 3.3 kW of heat and rejecting 2.3 kW of heat for every kW of power generated.

The efficiencies when using other cryogens may be similarly calculated:

$$\varepsilon_{Ne} = \frac{300 - 27.1}{300} = 91\%;$$

$$\varepsilon_{^3He} = 98.9\%;$$

$$\varepsilon_{^4He} = 98.6\%;$$

$$\varepsilon_{H_2} = 93\%;$$

$$\varepsilon_{CO} = 73\%;$$

$$\varepsilon_{Ar} = 71\%;$$

$$\varepsilon_{Kr} = 60\%.$$

In addition to enabling the achievement of relatively high efficiencies by providing large temperature differences across the engine 304, the use of liquid cryogen sources advantageously exploits the fact that the thermal conductivity of materials is generally reduced at lower temperatures. With thermal conductivities as low as those identified for the example cryogens in Table I, evaporation losses to the environment are relatively slow after initial equilibrium is reached, provided the cryogen source 308 has effective containment. As used herein, references to an "ambient" environment are intended to refer to an environment in which the thermodynamic engine is disposed that is large relative to the volume of the cryogen source 308. Conditions in the ambient environment, such as temperature, pressure, humidity, and the like, are substantially unchanged by operation of the thermodynamic engine. In many instances, the "ambient" environment thus refers to the atmospheric environment where the thermodynamic engine 304 is disposed. While it is possible in some specialized applications to prepare an environment with particular characteristics, such as within a building or other structure that has a controlled temperature and/or humidity, such an environment is considered to be "ambient" only where it is substantially larger than the volume of heat-sink material 308 and substantially unaffected by operation of the thermodynamic engine 304. It is noted that this definition of an "ambient" environment does not require a static environment. Indeed, conditions of the environment may change as a result of numerous factors other than operation of the thermodynamic engine—the temperature, humidity, and other conditions may change as a result of regular diurnal cycles, as a result of changes in local weather patterns, and the like.

In certain instances, conditions of the environment are intentionally manipulated to improve the efficiency of the engine 304. For example, the temperature difference across the engine 304 increased by locally increasing the temperature of a portion of the environment with an external heat source 328. Examples of heat sources that may be used include solar heat sources, nuclear heat sources, as well as burning of coal, oil, natural gas, wood, or the like. These heat sources may themselves represent waste heat that results from other power-generation mechanisms. For example, the heat rejected in a 70%-efficiency coal-burning plant may be directed to increasing the temperature differential across a thermodynamic engine as illustrated in FIG. 3. This provides an effective mechanism for making use of waste heat generated from alternative power-generation methods.

Alternatively or in addition to the use of an external heat source 328, embodiments of the invention may increase the temperature difference across the engine 304 through combustion of vaporized cryogen. This again represents the use of something that might otherwise be discarded as a waste product and may further increase the operational efficiency of the thermodynamic engine 304. A mechanism for such combustion is illustrated schematically in FIG. 3 with a combustion unit 310 that receives vapor from the cryogen source 308 by a direction mechanism 316. Combustion of the vaporized cryogen may use an oxidation source 320 to promote burning, with combustion byproducts then comprising oxides of the cryogen. FIG. 3 also illustrates direction of waste heat generated by combustion of cryogen vapor to locally increase a temperature on the hot side of the engine through mechanism 324. The overall energy output of the combination is increased by energy $E_2$ 314 to provide total energy generation $E_1+E_2$.

The use of certain cryogens may result in a power-generation system that is environmentally benign. For instance, consider the case where the cryogen comprises liquid hydrogen. With a boiling point of 20.4 K, the use of hydrogen provides a Carnot efficiency of the thermodynamic engine of about 93%. Operation of the thermodynamic engine 304 in an ambient environment 300 at standard temperature and pressure thus permits 100 $ft^3$ of liquid hydrogen to be used in the generation of 4.74 kWh of power. Combustion of the vaporized hydrogen with an oxidation source 320 may add an additional 7.93 kWh of power for a total power generation of 12.7 kWh. At current hydrogen prices in high volume, this results in a power-generation cost of about $0.044/kWh, lower than many competitive power-generation methods. The actual cost may be reduced somewhat further by enhancing the efficiency of the thermodynamic engine with heat from the hydrogen combustion. The arrangement is environmentally benign because water is the byproduct of the hydrogen oxidation. Still further efficiencies may be possible by using a portion of the energy generated by the thermodynamic engine for electrolysis of the water as a hydrogen source, but there are numerous processes that produce hydrogen as a byproduct at lower costs than electrolysis.

Figure 4:
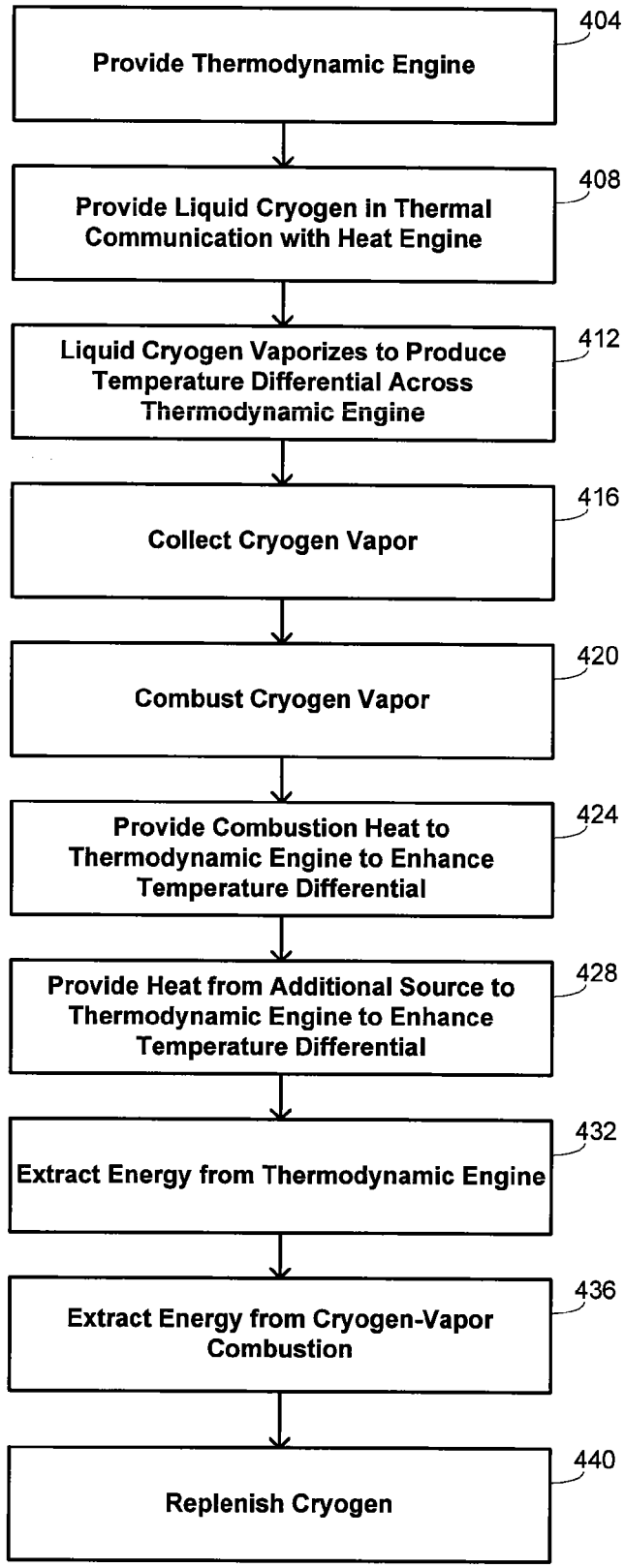
FIG. 4 is a flow diagram that summarizes methods for generating power in various embodiments.

Methods of the invention may accordingly be summarized with the flow diagram of FIG. 4. While the flow diagram includes a number of different steps that may be performed in various embodiments, it is not necessary that every step be performed and in some embodiments various additional steps may be performed. Moreover, it is not necessary that the steps be performed in the indicated order since other embodiments may use alternative orderings of steps. As indicated at block 404, a thermodynamic engine is provided. As previously noted, a variety of different types of thermodynamic engines may be used in different embodiments, with Stirling engines, thermoelectric engines, pyroelectric engines, and thermophotovoltaic engines providing specific examples. In some alternative arrangements, embodiments of the invention make use of steam generators or other types of Rankine engines as a heat engine. In such embodiments, the cold side is used to cool steam, with the hot side generating the steam.

Liquid cryogen is provided in thermal communication with the thermodynamic engine at block 408. The specific properties of individual cryogen sources may affect their suitability for specific implementations of the methods. Considerations that be made in selecting a cryogen source include the fact that cryogens with lower boiling points will generally provide greater efficiencies in power generation and that the availability and cost of different cryogens may vary. Additional considerations may account for how byproducts of operating the thermodynamic engine are to be used. For example, if cryogen vapor is to be oxidized in a combustion process, the toxicity of the chemical byproducts of the combustion and the cost of disposing of those byproducts may also affect the choice of cryogen.

Such combustion is indicated in the flow diagram at blocks 416 and 420 in the form of collecting cryogen vapor and subjecting it to combustion at block 420. One example of combustion includes oxidation processes that produce an oxide of the cryogen as a byproduct. As indicated at block 424, heat generated from the combustion may be provided in thermal communication with the thermodynamic engine to enhance the temperature differential that drives the engine. In some embodiments, such an enhancement in temperature differential may also or alternatively be provided with an additional source, as indicated at block 428. While there are a variety of additional heat sources that may be used, it is sometimes advantageous for this heat to be derived from waste heat of a secondary power-generation method.

Energy is extracted from the thermodynamic engine at block 432. This energy may be in the form of mechanical energy, electrical energy, or some other nonheat form of energy depending on the type of thermodynamic engine used. In embodiments that use combustion of cryogen vapor, energy may also be extracted from that part of the process at block 436. The various combination of processes indicated in FIG. 4 may combine to provide a high-efficiency for power generation in a manner that has little environmental impact. The use of cryogens in increasing the efficiency of power generation permits the thermodynamic engine to provided in a relatively compact fashion. These advantages may sometimes be enhanced further by including a mechanism for replenishing the cryogen as indicated at block 440. Such replenishment may take a number of different forms, including the use of electrolysis on oxide combustion byproducts, and allows the processes to be run substantially continuously over long periods of time.

Thus, having described several embodiments, it will be recognized by those of skill in the art that various modifications, alternative constructions, and equivalents may be used without departing from the spirit of the invention. Accordingly, the above description should not be taken as limiting the scope of the invention, which is defined in the following claims.

What is claimed is:

1. A method of generating power, the method comprising:

providing a liquid cryogen in thermal communication with a thermodynamic engine to maintain a temperature differential across the thermodynamic engine with a heat source;

running the thermodynamic engine to convert heat provided in the form of the temperature differential to a nonheat form of energy;

collecting cryogen-vapor produced by vaporization of the liquid cryogen; and combusting the cryogen vapor to generate additional energy.

2. The method recited in claim 1 wherein the heat source comprises an ambient environment within which the thermodynamic engine is disposed.

3. The method recited in claim 1 wherein combusting the cryogen vapor comprises producing heat in thermal communication with the heat source to enhance the temperature differential across the thermodynamic engine.

4. The method recited in claim 1 wherein the heat source comprises waste heat produced by a secondary power-generation method.

5. The method recited in claim 1 wherein the liquid cryogen has a boiling point less than −150° C.

6. The method recited in claim 1 wherein the liquid cryogen is selected from the group consisting of liquid nitrogen, liquid neon, liquid helium, liquid hydrogen, liquid carbon monoxide, liquid argon, and liquid krypton.

7. The method recited in claim 1 wherein the thermodynamic engine comprises a Stirling engine and the nonheat form of energy comprises mechanical energy.

8. The method recited in claim 1 wherein the thermodynamic engine comprises a thermoelectric engine and the nonheat form of energy comprises electrical energy.

9. The method recited in claim 1 further comprising replenishing the cryogen source.

10. The method recited in claim 9 wherein:

combusting the cryogen vapor comprises oxidizing the cryogen vapor to produce a cryogen oxide; and replenishing the cryogen source comprises electrolyzing the cryogen oxide.

11. The method recited in claim 1 wherein running the thermodynamic engine comprises operating a Rankine engine by generating vapor from a liquid with the heat source and condensing the vapor with the liquid cryogen.

12. A method of generating power, the method comprising:

providing a Stirling engine in an ambient environment;

providing liquid hydrogen in thermal communication with the Stirling engine to maintain a temperature differential across the Stirling engine with the ambient environment;

running the Stirling engine to convert heat represented by the temperature differential into mechanical energy;

collecting hydrogen vapor produced by vaporization of the liquid hydrogen;

oxidizing the hydrogen vapor to generate additional energy; and providing heat generated by oxidizing the hydrogen vapor to a portion of the Stirling engine to enhance the temperature differential across the Stirling engine.

13. The method recited in claim 12 further comprising providing waste heat generated from a secondary power-generation method to a portion of the Stirling engine to further enhance the temperature differential across the Stirling engine.

14. A system for generating power, the system comprising:

a thermodynamic engine configured to convert heat provided in the form of a temperature differential to a nonheat form of energy;

a liquid-cryogen source containing liquid cryogen in thermal communication with the thermodynamic engine to maintain the temperature differential across the thermodynamic engine with a heat source; and a combustion unit disposed to collect cryogen vapor produced by vaporization of the liquid cryogen and to combust the cryogen vapor to generate additional energy.

15. The system recited in claim 14 wherein the heat source comprises an ambient environment within which the thermodynamic engine is disposed.

16. The system recited in claim 14 wherein the combustion unit is further disposed to provide heat generated by combustion of the cryogen vapor in thermal communication with the heat source to enhance the temperature differential across the thermodynamic engine.

17. The system recited in claim 14 further comprising a secondary power-generation system, wherein the heat source comprises waste heat produced by the secondary power-generation system.

18. The system recited in claim 14 wherein the liquid cryogen has a boiling point less than −150° C.

19. The system recited in claim 14 wherein the liquid-cryogen source is selected from the group consisting of a liquid-nitrogen source, a liquid-neon source, a liquid-helium source, a liquid-hydrogen source, a liquid-carbon-monoxide source, a liquid-argon source, and a liquid-krypton source.

20. The system recited in claim 14 wherein the thermodynamic engine comprises a Stirling engine and the nonheat form of energy comprises mechanical energy.

21. The system recited in claim 14 wherein the thermodynamic engine comprises a thermoelectric engine and the nonheat form of energy comprises electrical energy.

22. A system for generating power, the system comprising:

means for converting heat provided in the form of a temperature differential to a nonheat form of energy;

means for maintaining the temperature differential with a heat source across the means for converting heat using a liquid cryogen; and means for combusting cryogen vapor produced by vaporization of the liquid cryogen to generate additional energy.

23. The system recited in claim 22 wherein the means for combusting cryogen vapor comprises means for producing heat in thermal communication with the heat source to enhance the temperature differential across the means for converting heat.

24. The system recited in claim 22 further comprising a secondary means for generating power, wherein the heat source comprises waste heat produced by the secondary means for generating power.

* * * * *

UNITED STATES PATENT AND TRADEMARK OFFICE

CERTIFICATE OF CORRECTION

PATENT NO. : 7,617,680 B1
APPLICATION NO. : 11/467854
DATED : November 17, 2009
INVENTOR(S) : Weaver et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 480 days.

Signed and Sealed this

Nineteenth Day of October, 2010

David J. Kappos

David J. Kappos
*Director of the United States Patent and Trademark Office*